US009908324B1

(12) United States Patent
Enge et al.

(10) Patent No.: US 9,908,324 B1
(45) Date of Patent: Mar. 6, 2018

(54) PRINTING WITH OVERLAPPING PRINTHEADS

(71) Applicant: Eastman Kodak Company, Rochester, NY (US)

(72) Inventors: James Michael Enge, Spencerport, NY (US); Michael J. Piatt, Dayton, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 15/442,791

(22) Filed: Feb. 27, 2017

(51) Int. Cl.
*B41J 29/393* (2006.01)
*B41J 2/045* (2006.01)
*B41J 2/155* (2006.01)

(52) U.S. Cl.
CPC ..... *B41J 2/04505* (2013.01); *B41J 2/04568* (2013.01); *B41J 2/155* (2013.01); *B41J 29/393* (2013.01)

(58) Field of Classification Search
CPC .... B41J 2/04505; B41J 2/04568; B41J 2/155; B41J 29/393
USPC ..... 347/12
See application file for complete search history.

(56) References Cited

U.S. PATENT DOCUMENTS 4,977,410 A 12/1990 Onuki et al.
5,450,099 A 9/1995 Stephenson et al.
6,357,847 B1 3/2002 Ellson et al.
6,540,315 B1 4/2003 Nystrom et al.
6,663,206 B2 12/2003 Taylor
6,793,319 B2 9/2004 Ikemoto et al.
7,118,188 B2 10/2006 Vilanova et al.
7,118,191 B2 * 10/2006 Fagan ..... B41J 2/145 347/41
7,240,986 B2 7/2007 Ikemoto et al.
7,510,256 B2 3/2009 Guarino et al.
7,871,145 B1 1/2011 Enge
7,971,961 B2 7/2011 Smythies
8,152,262 B2 4/2012 Seccombe
8,167,404 B2 5/2012 Mantell et al.
8,172,354 B2 5/2012 Takahashi et al.
8,292,398 B2 10/2012 Mizes et al.
(Continued)

FOREIGN PATENT DOCUMENTS

EP 0034060 8/1981
EP 0914950 5/1999

*Primary Examiner* — Huan Tran
*Assistant Examiner* — Alexander D Shenderov
(74) *Attorney, Agent, or Firm* — Kevin E. Spaulding

(57) ABSTRACT

A method for printing image data with a printing system having a staggered array of overlapping printheads. Adjacent printheads overlap in the cross-track direction defining an overlap region such that image pixels corresponding to the overlap region can be printed with either first or second printheads. The method includes defining an initial row interval N and an initial position of a transition boundary within the overlap region. N rows of image pixels are then printed wherein image pixels on one side of the transition boundary are printed using the first printhead and image pixels on the other side of the transition boundary are printed using the second printhead. A random process is used to iteratively determine updated row intervals, where the position of the transition boundary is shifted by an increment amount of between one pixel and three pixels for each row interval.

19 Claims, 11 Drawing Sheets

(56) References Cited

U.S. PATENT DOCUMENTS

| | | | | |
|---|---|---|---|---|
| 8,345,307 | B2 | 1/2013 | Saquib et al. | |
| 8,383,709 | B2 | 2/2013 | Eckel et al. | |
| 8,517,502 | B2 | 8/2013 | Mizes et al. | |
| 8,573,725 | B2 | 11/2013 | Snyder et al. | |
| 8,746,835 | B2 | 6/2014 | Wright et al. | |
| 8,807,692 | B2 | 8/2014 | Chen et al. | |
| 8,831,382 | B2 | 9/2014 | Tolstaya | |
| 8,842,330 | B1 | 9/2014 | Enge | |
| 8,842,331 | B1 | 9/2014 | Enge | |
| 8,888,219 | B2 | 11/2014 | Tanase et al. | |
| 2003/0160980 | A1 | 8/2003 | Olsson et al. | |
| 2004/0218200 | A1 | 11/2004 | Ebihara | |
| 2005/0174374 | A1* | 8/2005 | Ebihara | B41J 2/155 347/13 |
| 2006/0114282 | A1 | 6/2006 | Mizes et al. | |
| 2006/0125861 | A1 | 6/2006 | Silverbrook et al. | |
| 2008/0225074 | A1 | 9/2008 | Van de Wynckel et al. | |
| 2008/0225308 | A1 | 9/2008 | Saquib et al. | |
| 2009/0289986 | A1* | 11/2009 | Laaspere | B41J 2/2146 347/20 |
| 2010/0053246 | A1* | 3/2010 | Kasahara | B41J 2/155 347/12 |
| 2010/0182367 | A1* | 7/2010 | Takagi | B41J 2/145 347/14 |
| 2011/0141528 | A1* | 6/2011 | Hirano | B41J 2/04563 358/3.13 |
| 2014/0009527 | A1 | 1/2014 | Mongeon et al. | |
| 2016/0040340 | A1 | 2/2016 | Goldman et al. | |

* cited by examiner

PRINTING WITH OVERLAPPING PRINTHEADS

FIELD OF THE INVENTION

The field of the invention relates to page-width printing systems that print image data using a plurality of overlapping printheads that are staggered in the page-width direction, and more particularly to methods and algorithms for printing the image data in the overlap region.

BACKGROUND OF THE INVENTION

Stitching refers to the alignment of the printed image data from multiple jetting modules for the purpose of creating the appearance of a single page-width linehead for printing on a print medium 16. For example, as shown in FIG. 1, seven jetting modules 2, each being three inches in length, can be aligned together to form a page-width linehead 4 spanning twenty-one-inches in the cross-track direction 23. The jetting modules 2 can also be interchangeably referred to as "printheads" within the context of the present disclosure. Dashed lines are used to show the print boundaries 3 of the first-row jetting modules 2 as the print medium 16 moves past the linehead 4 in the in-track direction 22, passing from the first row 7*a* of jetting modules 2 to the second row 7*b* of jetting modules 2. The page-width image data is processed and segmented into separate segments to be printed with each jetting module 2, and then a segment is sent (with an appropriate module-to-module time delay to account for the staggered separation of the jetting modules 2) to the print nozzles 6 of each jetting module 2 for printing. The result of proper stitching is a continuous print band 60 that spans the width of the linehead 4 with no artifacts at the seams 64 between the swaths 62 of pixels 66 printed by the separate jetting modules 2 as shown in the lower portion of FIG. 1.

However, though it may be anticipated that the module-to-module alignment may be very good, mechanical tolerances may be difficult to consistently maintain, and therefore alignment will often not be perfect. Moreover, even if the jetting modules 2 are perfectly aligned, differences in the nozzle aim between jetting modules 2 may make them appear to be misaligned in the printed output. Consequently, this type of conventional, multi-segment linehead configuration suffers from the drawback that the pitch of the output lines along the print boundaries 3 between adjacent jetting modules 2 is irregular and thereby causes lines of lower (if the jetting modules 2 are too far apart) or higher (if the jetting modules 2 are too close together) density to appear at the print boundaries 3 between each jetting module 2, and thus impairs the quality of the printed pattern of the output. On the print medium, such misalignment in the cross-track direction 23 typically produces a gap or "white-line" artifact 8*a* (as shown in FIG. 2A) or an overlap or "dark-line" artifact 8*b* (as shown in FIG. 2B) at the seam 64 between two swaths 62*a* and 62*b*.

With a view to overcoming the presence of visible gaps or bands in the printed image, U.S. Pat. No. 7,118,188 (Vilanova et al.) teaches deliberately positioning the jetting modules (i.e., the printhead dies) of an inkjet printer with a small overlap, specifically no more than a few times the nozzle spacing. As a result of the redundancy of nozzles in the region where adjacent jetting modules overlap, this gives flexibility for compensating for gaps or bands produced by inaccuracies in locating the jetting modules and thus in setting the overlap dimension. Although, in an ideal case, 100% of the required amount of ink (maximum) would be printed by only 50% of the nozzles of each jetting module in the overlap region, in practice more or fewer of the nozzles may be fired to compensate for imperfections. For example, if the overlap is less than intended, the production of a gap is avoided by firing some of the nozzles which would not be fired in the ideal case.

A printing mask is a means for selectively masking off certain nozzles (i.e., preventing the nozzles from firing even if printing instructions for those nozzles should include an instruction to fire). The aforementioned U.S. Pat. No. 7,118,188 further discloses a method of adding stitching masks to the printed image content, where artifacts in the printed image caused by the printing nozzles in the overlapping region are removed, either by (a) measuring the width of the band produced in the overlapping region and selecting an appropriate stitching mask for subsequent printing operations, or by (b) printing out a test pattern in which areas corresponding to a range of stitching masks are printed out and the optimal mask is selected for subsequent printing operations. The stitching mask is then added to, or superimposed on, the printing masks to ensure that the required correction is made independently of the content to be printed.

The aforementioned U.S. Pat. No. 7,118,188 further discloses that the target may comprise an array of target patches overlapping the boundaries between the jetting modules and including a range of stitching masks. The magnitudes of the boundary artifacts are then assessed, either by a user of the machine or automatically by an optical sensor/scanner system. In the first option, a user visually examines the patches in each row and selects the one with the better area fill uniformity at the printed region corresponding to the jetting module boundary. The corresponding stitching mask is then applied to that jetting module boundary in subsequent normal printing operations. In the second option, an optical sensor moves over all the patches detecting the boundary artifact level. The most appropriate stitching mask is then selected for each jetting module pair and supplied to a printer control system, where the masks will then be used in subsequent normal printing operations.

In relation to page-width thermal printers, U.S. Pat. Nos. 4,977,410 and 5,450,099 each disclose a thermal line printer including a plurality of staggered linear head segments arranged in a pair of parallel rows such that the head segments partly overlap with each other in overlap regions near the ends of each head segment. In commonly-assigned U.S. Pat. No. 5,450,099 (Stephenson et al.), the print data in the overlap region is interleaved to eliminate boundary artifacts at the juncture between segments. In U.S. Pat. No. 4,977,410 (Onuki et al.), the initial assignment of image bit data to a head segment in the overlap region is shifted lengthwise to accommodate for boundary artifacts at the juncture between head segments.

In relation to a carriage-type printer wherein a printhead is attached to a carriage that is reciprocated to print one swath of information at a time on a stationary print medium, U.S. Pat. No. 6,663,206 (Taylor) discloses methods for masking stitch errors between adjacent swaths laid down by operation of such a printer. In contrast with the aforementioned examples of page-width printers that utilizes a linehead including an array of stationary printheads, after each swath is printed by the carriage-type printer the print medium is stepped a distance equal to the height of the swath so that the next printed swath overlaps the pixels from the last line of the previously printed swath. When a controller determines that a stitch joint error will occur based on the current relative location between the printhead and the location of the previous swath on the print medium, the location of the next swath is adjusted relative to the position of the previous swath to eliminate the stitch joint error.

According to U.S. Pat. No. 6,663,206, the data is shifted in the printhead so that the data for the next swath is aligned within a predetermined pixel accuracy to the measured paper position (e.g., by having a later nozzle fire the pixel data originally set to be fired by the first nozzle of the printhead). In addition, the remaining stitch joint error is covered up by modifying the pixels at the stitch interface. In one example, the pixels created in the region between the last line of the previous swath and the first line of the next swath can be a duplicate line of either the last line of the previous swath or the first line of the next swath, where the size and/or density of the pixels can be changed. In another example, for situations where the stitch error is less than a pixel, in addition to shifting the data and firing the information set to be printed, the controller will also fire a line of fill pixels from the nozzle prior to and immediately adjacent to the first-fired nozzle. The purpose of a fill pixel is to bridge the gap between a printed pixel from the last fired nozzle of the previous swath and a corresponding adjacent printer pixel that will be formed when the first line of pixels is formed by the nozzle that will be used for the first line of pixels for the next swath. According to U.S. Pat. No. 6,663,206, the fill pixels create a printed image having more uniform continuity and density. The fill pixels are not produced for all of the pixels located in the last line of the previous swath. Instead, the fill pixels are produced when a printed pixel is located in the same position in both the previous swath and the next swath. The fill pixels can also be at a reduced size and/or density.

Stitch joint errors in a drop-on-demand carriage-type system can be the result of a gap between the drop of one swath adjacent the stitch joint and the drop of an adjoining swath adjacent the same stitch joint. As explained in U.S. Pat. No. 6,663,206, the gap is usually caused by difficulties in producing adjacent swaths close enough together to mask this apparent error, and the correction must be produced on-the-fly during a production run. In contrast, as also explained in U.S. Pat. No. 6,663,206, a page-width printer includes a stationary printhead having a length sufficient to print across the width or length of the sheet of print medium. The print medium is continually moved past the page-width printhead in a direction substantially normal to the printhead length and at a constant or varying speed during the printing process. Thus, it would be understood that a page-width printer would avoid the need for on-the-fly corrections between swaths during a production run.

Even with such algorithms, under some conditions an artifact can still form at the seams. In particular, visible artifacts can be seen under print conditions in which the print medium 16 drifts laterally back and forth during printing. This is illustrated in FIG. 3, which shows a portion of a linehead 4 and a portion of a print band 60 under the condition of a lateral drift in print medium 16 producing a slight skewing of the print medium 16. This skewing of the print medium 16 causes the print swath printed by the upper jetting module 2 to be shifted to the left as the print medium 16 advances to the lower row of jetting modules 2. This shift of the center print swath produces a larger than normal pixel spacing at seam 64*a* and a smaller than normal printed pixel spacing at the seam 64*b*. As the print medium 16 drifts back and forth, it can cause the apparent pixel spacing at the seams to be modulated. While the different stitching algorithms described above can conceal the seams when the pixel spacing at the seams is static, they cannot conceal the seams when the pixel spacing at the seams modulates.

Even if the artifacts at the seams are quite small, they might be detected by an observer because the human vision system is particularly effective in detecting a collection of image artifacts when the artifacts are aligned along a line. In recognition of this, European Patent Application EP0034060 (Kockler) discloses a stitching algorithm in which from one row of pixels to the next, the stitching boundary is randomly or cyclically shifted around within a 16-pixel overlap region. By dispersing the position of the stitch boundary in this manner, the stitch artifacts produced by variations in the printed pixel spacing across a seam between swaths are less noticeable to the human observer.

However, if there are in-track shifts between adjacent swaths the randomly dithered stitch boundary can produce a different type of print artifact. This is illustrated in FIG. 4, which shows a portion of two adjacent print swaths 62*a*, 62*b*, with a dithered stitch boundary 68. The pixels 66 of the two different swaths are denoted by differing hatch patterns. The dithering of the stitch boundary 68 creates a seam comprising interdigitated fingers 74 printed by the two swaths 62*a*, 62*b*. Swath 62*a* is displaced both in the cross-track direction 23 and the in-track direction 22 relative to a proper alignment with swath 62*b*. The in-track placement error causes horizontal gaps 70 to appear between some of the interdigitated fingers 74, and excessive coverage regions 72 to appear between others of the interdigitated fingers.

To reduce the visibility of gap and excessive overlap artifacts produced by the dithered stitch boundary, U.S. Pat. No. 6,357,847 (Ellson et al.) teaches randomly shifting the position of the stitch boundary, not on a pixel row-by-pixel row basis, but rather shifting the position of the stitch boundary every $N^{th}$ pixel row, where N>1. Such a change reduces the number of gaps and excessive coverage regions produced by the dithered stitch boundary by a factor N, to reduce the visibility of these artifacts.

U.S. Patent Application Publication 2004/0218200 (Ebihara) discloses an alternate approach to reducing the visibility of the artifacts produced by the random dithering of the stitch boundary by altering the weighting profile for the placement of the stitch boundary on any given step. By decreasing the probability for placement of the stitch boundary at the extremes of the overlap region, it reduced the probability of large steps in the placement of the stitch boundary. By doing this, the average length of the horizontal gaps and the excessive coverage regions is reduced, thereby reducing the visibility of these artifacts.

Even with such stitching algorithms, there remains a need for improved stitching algorithms to reduce or eliminate visible artifacts at the swath seams.

SUMMARY OF THE INVENTION

The present invention represents a method for printing image data including rows of image pixels with a printing system having a plurality of printheads for printing a particular image plane in a single pass, the printheads being oriented in a cross-track direction onto a print medium moving past the printheads in an in-track direction, wherein first and second printheads overlap in the cross-track direction defining an overlap region such that image pixels corresponding to the overlap region can be printed with either the first printhead or the second printhead, including:

a) defining an initial position of a transition boundary within the overlap region;

b) defining an initial row interval N, where N>1;

c) printing N rows of image pixels wherein image pixels on a first side of the transition boundary are printed using the first printhead and image pixels on a second side of the transition boundary are printed using the second printhead;

d) using a random or pseudo random process to determine an updated row interval N;

e) shifting the position of the transition boundary by an increment amount of between one pixel and three pixels in the cross-track direction; and f) repeating steps c)-e) a plurality of times.

This invention has the advantage that the transition boundaries between swaths of image data printed with different printheads have a reduced visibility to a human observer.

It has the additional advantage that the transition boundaries have an aperiodic shape with gradual transitions that avoid the formation of large gaps and large areas of excessive in coverage.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

In the following description, some embodiments of the present invention will be described in terms that would ordinarily be implemented as software programs. Those skilled in the art will readily recognize that the equivalent of such software may also be constructed in hardware. Because printing systems employing stitching methods are well known, the present description will be directed in particular to elements forming part of, or cooperating more directly with, methods in accordance with the present invention. Elements useful in practicing the methods but not specifically shown or described herein may be selected from those known in the art. Certain aspects of the embodiments to be described may be provided in software. Given an understanding of the system as shown and described according to the invention in the following materials, system components and software not specifically shown, described or suggested herein that is useful for implementation of the invention is conventional and within the ordinary skill in such arts.

A data processing system that includes one or more data processing devices is generally used to implement the processes of the various embodiments of the present invention, including the example processes described herein. The phrases "data processing device" or "data processor" are intended to include any data processing device, such as a central processing unit ("CPU"), a desktop computer, a laptop computer, a mainframe computer, a hand held computer, or any other device for processing data, managing data, or handling data, whether implemented with electrical, magnetic, optical, biological components, or otherwise.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Figure 5:
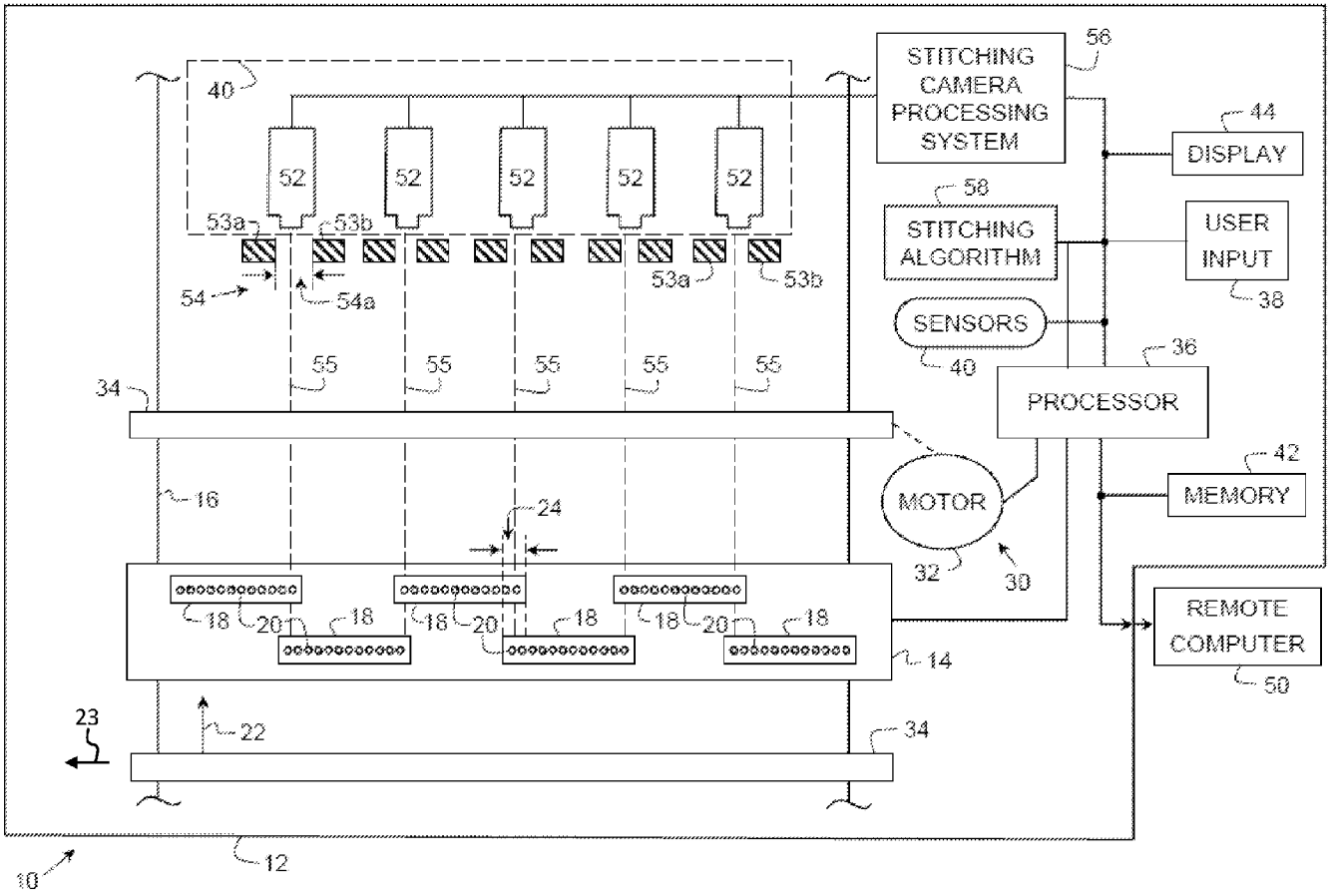
FIG. 5 is a diagram of a printer, including a linehead having an array of staggered, overlapping jetting modules, incorporating a stitching algorithm according to the invention.

FIG. 5 shows an embodiment of a printer 10 incorporating the invention. In the embodiment of FIG. 5, the printer 10 comprises a housing 12 having a linehead 14 that applies markings or otherwise forms an image on a print medium 16. The linehead 14 includes a fixed array of overlapping jetting modules 18, where adjacent jetting modules 18 are staggered such that a portion of the nozzles 20 of adjacent jetting modules 18 overlap in an overlap region 24. (The overlap region 24 is shown for illustration in FIG. 5 between two of the jetting modules 18, but it should be understood that such overlap regions also exist between the other jetting modules 18.) The width of the overlap region is typically between 15 pixels in 40 pixels.

The linehead 14 can record images on the print medium 16 using a variety of known digital marking technologies including, but not limited to, drop-on-demand inkjet technology and continuous inkjet technology. For the purpose of illustrating the following discussions, the linehead 14 will be described as being useful with continuous inkjet technology that generates monotone images such as black and white, grayscale or sepia toned images. However, it will be appreciated that these limitations are not necessary attributes of the invention and that the claimed methods herein described can be practiced, for example, with a linehead 14 that generates color images, or with other known digital marking technologies such as drop-on-demand inkjet technology.

FIG. 5 shows in part a schematic top plan view of a fixed, page-width linehead 14 including six staggered jetting modules 18, each comprising at least one row of nozzles 20 which are arranged, in the preferred embodiment, to fire ink drops onto the print medium 16 as it is advanced through the printer 10 in the in-track direction 22. The overlap regions 24 due to the staggering between adjacent jetting modules 18 are shown on an exaggerated scale for the purposes of explanation, and effectively provide two page-width rows of nozzles. In practice, in-track timing delays for each jetting module 18 are used to obtain in-track registration, that is, registration in the in-track direction 22, for the printed output from the staggered modules 18. In an exemplary arrangement, six approximately 4.25 inch width jetting modules 18 are arranged in two staggered rows spaced 6 inches apart in the in-track direction 22 to provide a 24.5 inch print-width linehead 14 in the cross-track direction 23. As shown in FIG. 5, jetting modules 18 are oriented such that the rows of nozzles 20 of jetting modules 18 are aligned along the cross-track direction 23 which is perpendicular to the in-track direction 22 (i.e., the direction that the print medium 16 travels past the jetting modules 18). Other orientations of the rows of nozzles 22 are also permitted. For example, the rows of nozzles 20 can be positioned at a non-perpendicular, non-parallel angle relative to both the in-track direction 22 and the cross track direction 23. Additionally, while two rows of jetting modules 18 are shown in the illustrated arrangement, it is contemplated that more than two rows of jetting modules 18 can be used with the present invention. For example, three rows, four rows, or more than four rows of jetting modules 18 can be implemented in a printing system incorporating the present invention.

A media transport system 30 is used to position the print medium 16 relative to the linehead 14 to facilitate recording of an image on the print medium 16. The media transport system 30 can comprise any number of well-known systems for moving the print medium 16 within the printer 10, including a motor 32 driving pinch rollers 34, a motorized platen roller (not shown) or other well-known system components for the movement of paper or other types of print medium 16.

The linehead 14 and the media transport system 30 are operated by a processor 36. The processor 36 can include but is not limited to a programmable digital computer, a programmable microprocessor, a programmable logic processor, a series of electronic circuits, a series of electronic circuits reduced to the form of an integrated circuit, or a series of discrete components. The processor 36 operates the printer 10 based in part upon input signals from one or more of a user input system 38, sensors 40, a memory 42, a stitching algorithm 58, and (when connected) a remote computer system 50. A display 44 can provide to a user, without limitation, displays indicating information, images and operating data useful in implementing the stitching algorithm of the invention.

The user input system 38 (which, in certain applications, can be used to select masks or parameters for implementing the stitching algorithm of the invention) can comprise any form of transducer or other device capable of receiving an input from a user and converting this input into a form that can be used by the processor 36.

The memory 42 can include conventional memory devices including solid state, magnetic, optical or other data storage devices. The memory 42 can be fixed within the printer 10 or it can be removable. For instance, although not shown, the printer 10 may include a hard drive, a disk drive for a removable disk such as an optical, magnetic or other disk memory, or a memory card slot that holds a removable memory such as a removable memory card and has a removable memory interface for communicating with removable memory. Data including but not limited to control programs, digital images and metadata can also be stored external to the printer 10 in the remote computer system 50, such as a personal computer, a computer network or other digital system.

The sensors 40 can optionally include image capture devices or other light sensors known in the art that can be used to capture images of targets to determine, for example, optimal correction amounts for the stitching algorithm 58 in accordance with the invention. This information can be captured and processed automatically and converted into a form that can be used by the processor 36 in governing operation of the linehead 14 and jetting modules 18 and/or other systems of the printer 10. Alternatively, the images of the targets can be visually examined by an operator and correction amounts can be entered through the user input system 38. The sensors 40 can also include positioning and other sensors used internally to sense operating conditions, such as web speed, and thereby control printer operations.

According to a preferred embodiment, the sensors 40 are used in a stitching calibration process and further include a plurality of stitching cameras 52 oriented along the stitch joints 55 between the jetting modules 18 to capture a stitching calibration target 54. The stitching calibration target 54 can include patches 53*a* and 53*b* printed by adjacent printheads which are separated by a defined gap 54*a* at each stitch joint 55. The captured target data is applied to a stitching camera processing system 56, which can compare the relative placement of the patches 53*a* and 53*b* associated with a stitch joint 55 with the intended relative placement of these patches to determine a relative placement of the adjacent print swaths at the stitch joint 55. The stitching camera processing system 56 can then generate stitching parameters that are applied to the processor 36 and used in the stitching algorithm 58.

Figure 6:
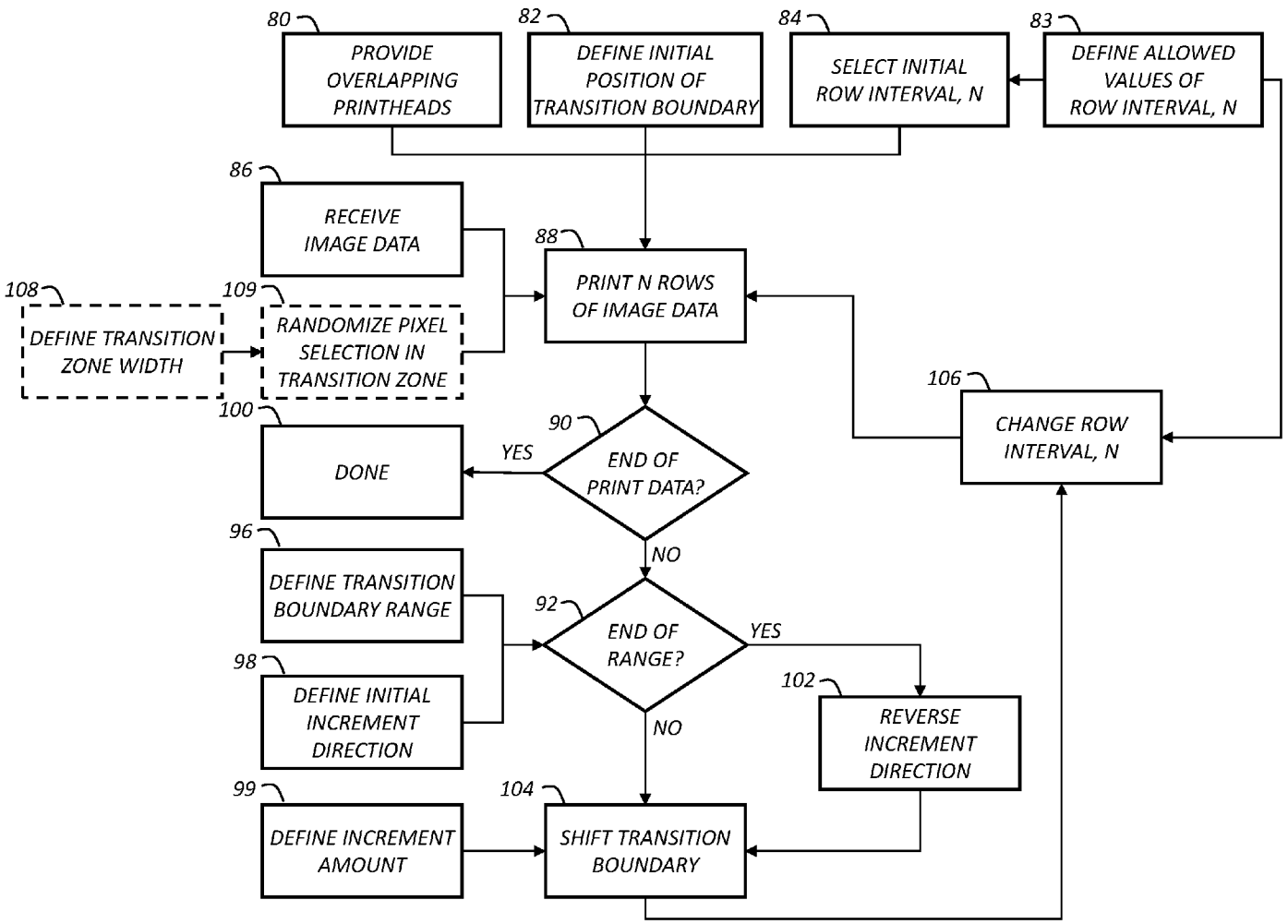
FIG. 6 is a flow chart of a method for stitching swaths together in accordance with an exemplary embodiment.

Unlike the prior art in which the transition boundary separating adjacent print swaths is moved in the cross-track direction for every print row or every $M^{th}$ row, the transition boundary in the present method is shifted at random or pseudo-random intervals. An exemplary process by which the transition boundary is shifted in accordance with a preferred embodiment is illustrated in the flow diagram of FIG. 6. The process begins with a provide overlapping printheads step 80. This step involves providing a printing system with a plurality of printheads (e.g., the jetting modules 18 of FIG. 5) for printing image data in a single pass. The plurality of printheads are oriented in a cross-track direction 23 (FIG. 5) adjacent to a print medium 16 (FIG. 5) which moves relative to the printheads in an in-track direction 22 (FIG. 5). Printheads that print adjacent swaths on the print medium 16 are positioned in the cross-track direction 23 such that the print swaths partially overlap to define an overlap region 24 (FIG. 5), the pixels of which can be printed by either of the adjacent printheads.

In a define initial position of transition boundary step 82, the initial cross-track position of a transition boundary within the overlap region 24 is defined. The pixels in the overlap region 24 on a first side of the transition boundary are printed by a first printhead that prints a first swath, and pixels in the overlap region 24 on a second side of the transition boundary are printed by a second printhead that prints a second swath.

In define allowed values of row interval step 83 a set of allowed values for a row interval N are defined. The row interval N is a parameter that is used to define the number of consecutive print rows that are printed between shifts in the position of the transition boundary. In an exemplary embodiment, the range of allowable row intervals N is between 2 rows and 900 rows. (In the context of the present disclosure, when a range is defined as being between a value A and a value B, the range is inclusive of the endpoints A and B.)

Preferably, the limits on the row interval are selected such that the spacing between the rows where the position of the transition boundary is shifted less than or equal to 0.5 inches as longer distances between shifts of the transition boundary increase the chance that the artifact aligned at the transition boundary can be detected. Even more preferably, the spacing between the rows where the transition boundary is shifted is less than or equal to 0.25 inches. It is also preferable for the limits on the allowable row intervals to be selected such that the spacing between the rows where the position of the transition boundary is shifted is greater than or equal to 0.001 inches as closely spaced steps in the transition boundary increase the risk that artifacts at the steps in the transition boundary position can be detected. Even more preferably, the spacing between the rows where the position of the transition boundary is shifted is greater than or equal to 0.002 inches.

In some arrangement, the allowed row interval values do not include all of the values within the defined range, but rather a limited selection of row interval values are defined within the allowed range. For example, the row interval values might have an allowable range from N=16 to 400 but be limited to steps of 16; so that the allowable row interval values are limited to N=16, 32, 48, . . . 400. In some such embodiments, the allowable row interval values correspond to a random integer within some range (e.g., 1 to 25) multiplied by a step size parameter (e.g., 16).

In select initial row interval step 84, an initial value for the row interval N is selected from the set of allowable row interval values. In some configurations, the initial row interval value is randomly selected from the set of allowable row interval values. In other configurations, the initial row interval value can correspond to a predefined value.

In receive image data step 86, the printing system receives the image data to be printed. The received image data can be in the format of a print-ready bitmap or in other various forms, such as a page description defined using a page descriptor language. When the image data is in a form other than a print-ready bitmap, the receive image data step 86 also includes the processing steps required to convert the image data into print-ready bitmap form. The processing steps can include but are not limited to page layout processing steps, merging of fixed and variable data steps, positioning and resizing of images steps, and the steps of separating color images into different image planes (also called color planes, such as CMYK color planes) and halftoning the image planes into a print-ready format.

In print rows of image data 88, N rows of image data are printed using the plurality of printheads. This step includes the step of segmenting the image data into the segments to be printed by each of the individual printheads in the plurality of printheads. It also includes the application of the appropriate delays to the different printheads to ensure that that swaths printed by each of the printheads are properly aligned in the in-track direction 22.

An end of print data test 90 is used to determine whether all of the image data has been printed. If the printing of all the image data is complete, the process moves to done step 100, in which the process is terminated. If there is more image data to be printed, the process moves to end of range test 92.

In a preferred embodiment, rather than randomly moving the transition boundary separating adjacent print swaths within some defined range the cross-track direction 23, the transition boundary is incrementally shifted in one direction across a defined range, and then the transition boundary is incrementally shifted in the other direction.

A define transition boundary range step 96 is used to define the range of transition boundary positions in the cross-track direction 23 in which the transition boundary can be shifted. In some embodiments, the range comprises the entire overlap region 24 (FIG. 5) of the adjacent printheads, while in other embodiments the range is only a portion of the overlap region.

Figure 7:
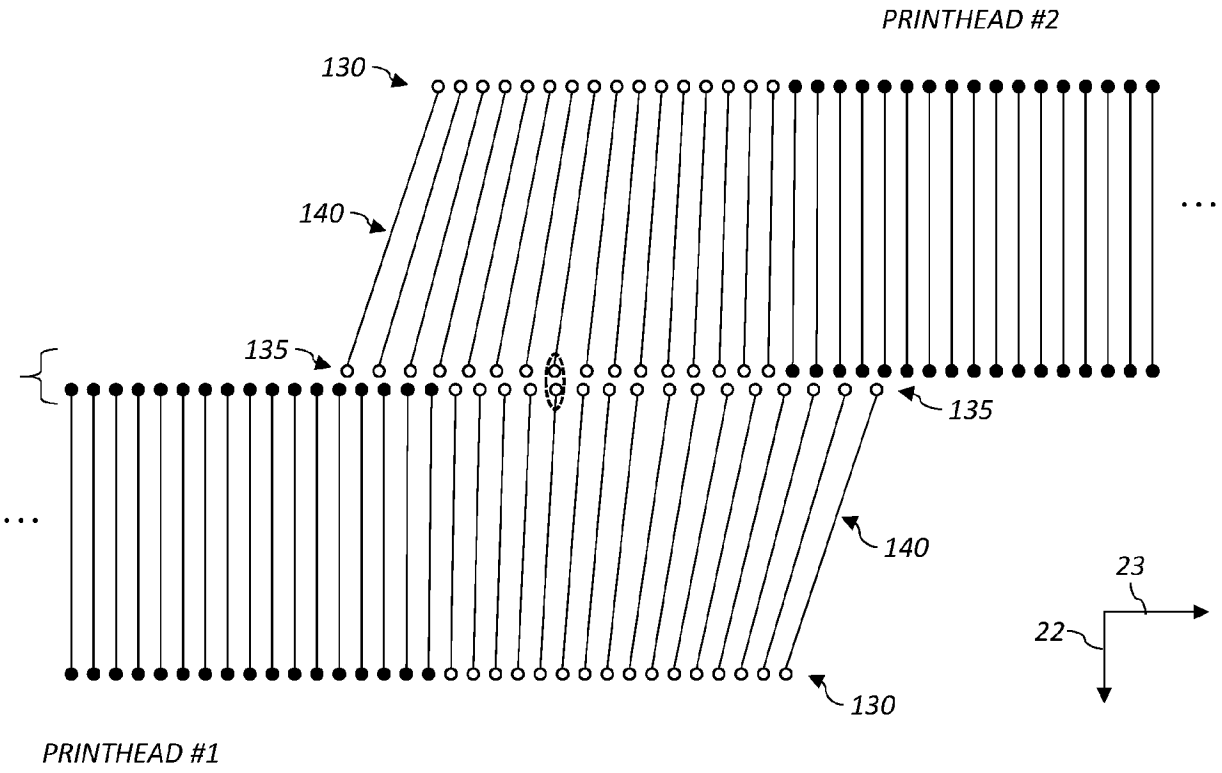
FIG. 7 illustrates a dot placement artifact that can occur near the ends of the nozzle array, which can affect stitching.

It has been observed that near the ends of a jetting module 18 (FIG. 5), aerodynamic forces can cause the drop trajectories to fan out slightly so that the printed pixel spacing is slightly larger than the nozzle-to-nozzle spacing, with the printed pixel spacing increasing toward the ends of the jet array. This is illustrated in FIG. 7, in which the dots printed by a first and second printhead are shown near the middle of the figure with a slight vertical offset between them to allow the dot placement from each printhead to be more clearly seen. The fan out can be observed by comparing the drop trajectories 140 connecting the nozzle positions 130 to the corresponding printed dot positions 135. To enable the fan out of the drop trajectories 140 to be more clearly seen, the drop trajectories 140 of the drops from the Printhead #1 have been inverted so the drop trajectories 140 start at the nozzle positions 130 near the bottom of the figure heading upward to the corresponding printed dot positions 135. The drop trajectories 140 of the drops from Printhead #2 are directed downward. As a result of the fan out of the drop trajectories 140, the alignment of the dots printed by the Printhead #1 shift when compared to the closest corresponding dots from Printhead #2. An ellipse encircles the pair of print dots that are best aligned with each other from the two printheads. In some embodiments, the range of pixel positions through which the transition boundary can migrate is selected to be centered about the drop pair in the overlap region that have the best alignment between the adjacent printheads. The range may further be selected to avoid printing with the nozzles close to the ends of the nozzle arrays that have excessive fan out of the drop trajectories 140.

A define initial increment direction step 98 is used to define the initial direction for the shifting of the transition boundary (i.e., whether the transition boundary initially shifts from right-to-left across the print media or initially shifts from left-to-right.

Figure 1:
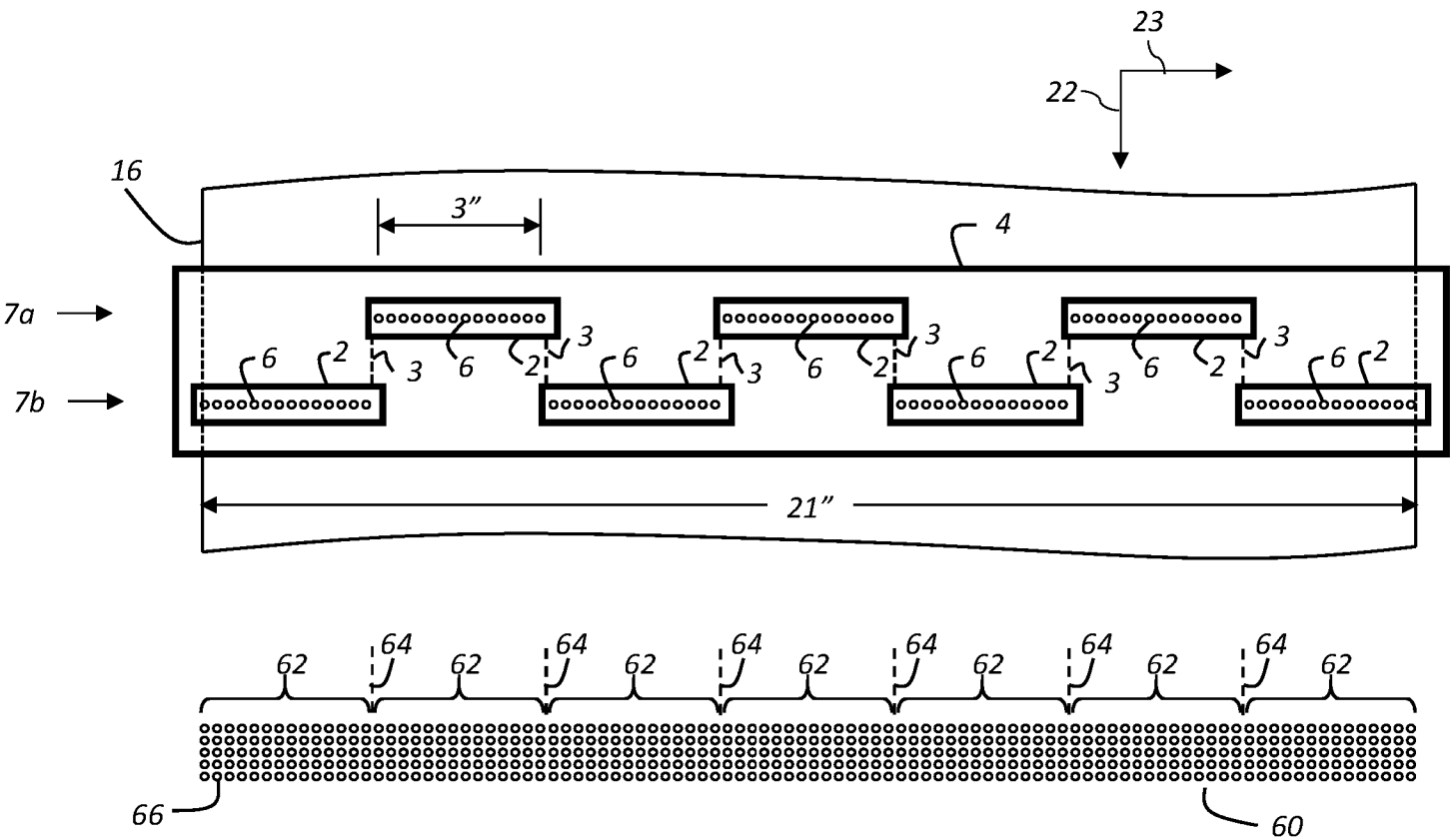
FIG. 1 (Prior Art)
FIG. 1 illustrates a page-width linehead including a staggered array of jetting modules that are stitched together to span the width of the print medium.
Figure 2B:
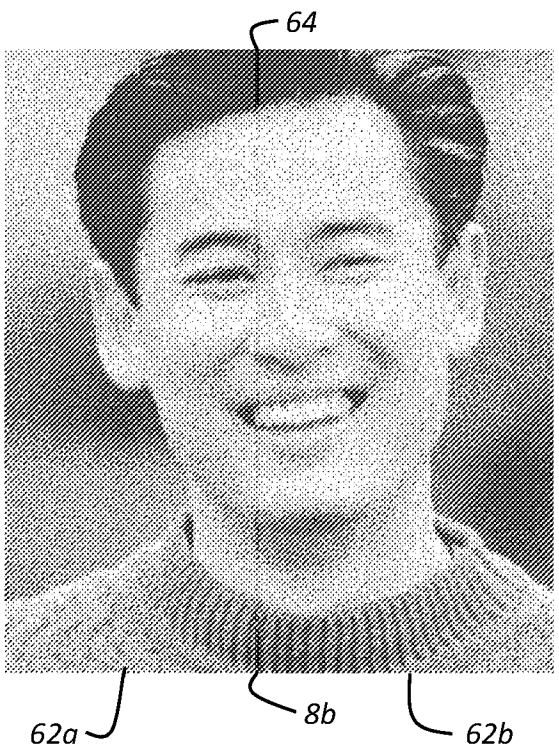
FIG. 2B (Prior Art)
FIG. 2B shows a "dark line" artifact caused by a misalignment of the jetting modules shown in FIG. 1.
Figure 2A:
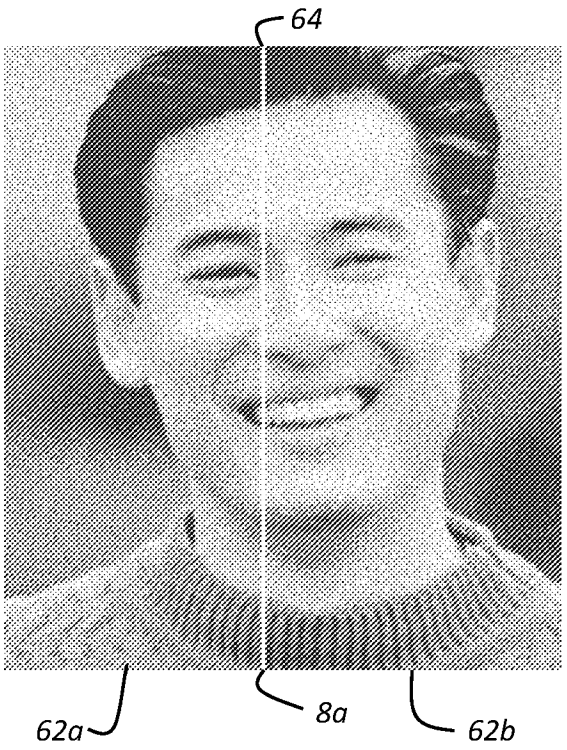
FIG. 2A (Prior Art)
FIG. 2A shows a "white line" artifact caused by a misalignment of the jetting modules shown in FIG. 1.
Figure 3:
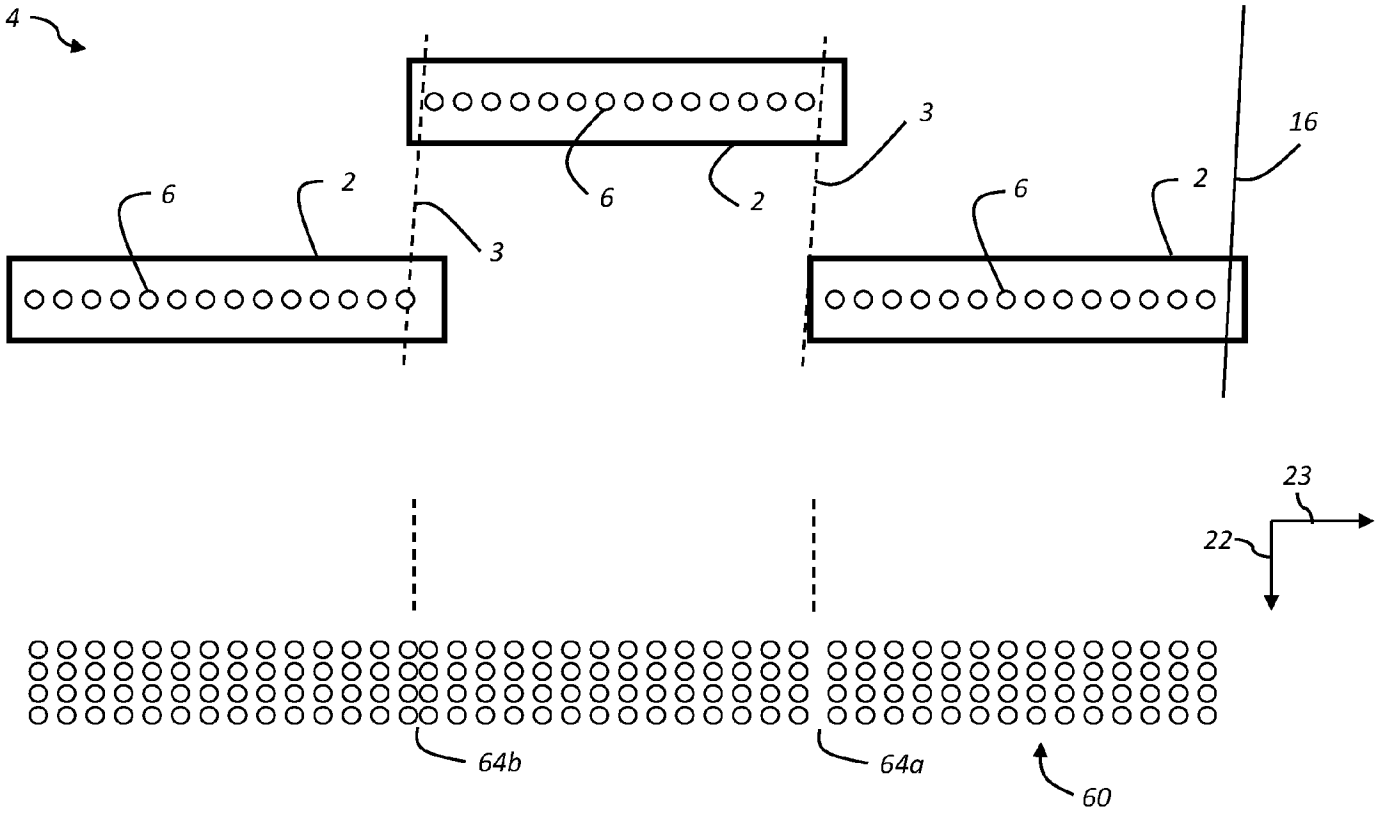
FIG. 3 (Prior Art)
FIG. 3 illustrates artifacts formed at the seams between printing modules resulting from skew of the print medium.
Figure 4:
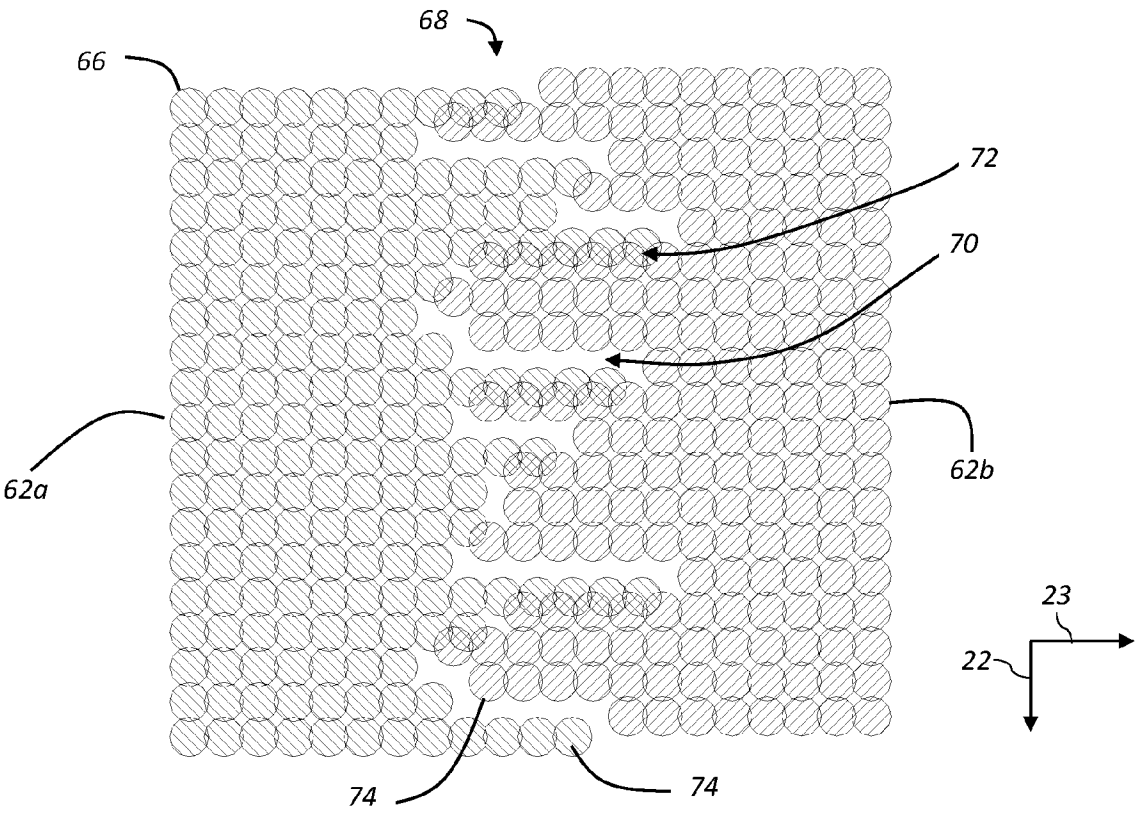
FIG. 4 (Prior Art)
FIG. 4 illustrates print artifacts produced by a prior art stitching algorithm.

In define increment amount step 99, an increment amount for the transition boundary is defined. In an exemplary embodiment, a fixed increment amount is used, which is preferably between 1 and 3 pixels (inclusive of the end points). By keeping the increment amount to three or less, the visibility of the artifact illustrated in FIG. 4 can be kept to an acceptable low level.

The end of range test 92 is used to determine whether the transition boundary has reached the end of the defined range such that the increment direction needs to be reversed. In this step, the position of the transition boundary is checked relative to the transition boundary range defined in define transition boundary range step 96. If the transition boundary is found to not be at one of the limits of the defined range, the process advances directly to shift transition boundary step 104. If the transition boundary is found to be at one of the limits of the defined range, the process is advanced to reverse increment direction step 102, in which the increment direction is reversed relative to the previously defined increment direction after which the process is advanced to shift transition boundary step 104. In some embodiments, the increment direction can be reversed before the transition boundary reaches the limits of the defined range. For example, the increment direction can be randomly selected using a random or pseudo-random process.

In shift transition boundary step 104, the transition boundary is incrementally shifted by the defined increment amount in the current increment direction, and the process then advances to change row interval step 106.

In change row interval step 106, a new value for the row interval, N, is selected from the set of allowed values of the row interval N, which were defined in define allowed values of row interval step 83. In a preferred embodiment, the values of N are randomly or pseudo-randomly selected from the set of allowed row interval values. In this specification, the term pseudo-random refers to a process that approximates a true random process. Examples of pseudo-random processes include a truly random sequence, a finite set of random decisions that are then repeated, a deterministic algorithm that generates a random-like sequence, and any combination of the stated techniques that will approximate a random process. New row interval values within a preferred range can be generated as needed, or a sequence of random or pseudo-random values within the preferred range can be generated ahead of time and the row interval values can be retrieved from the sequence as needed.

At this point, the process returns to print rows of image data step 88, and the process is repeated until all the image data has been printed as determined in end of print data test 90.

Figure 8:
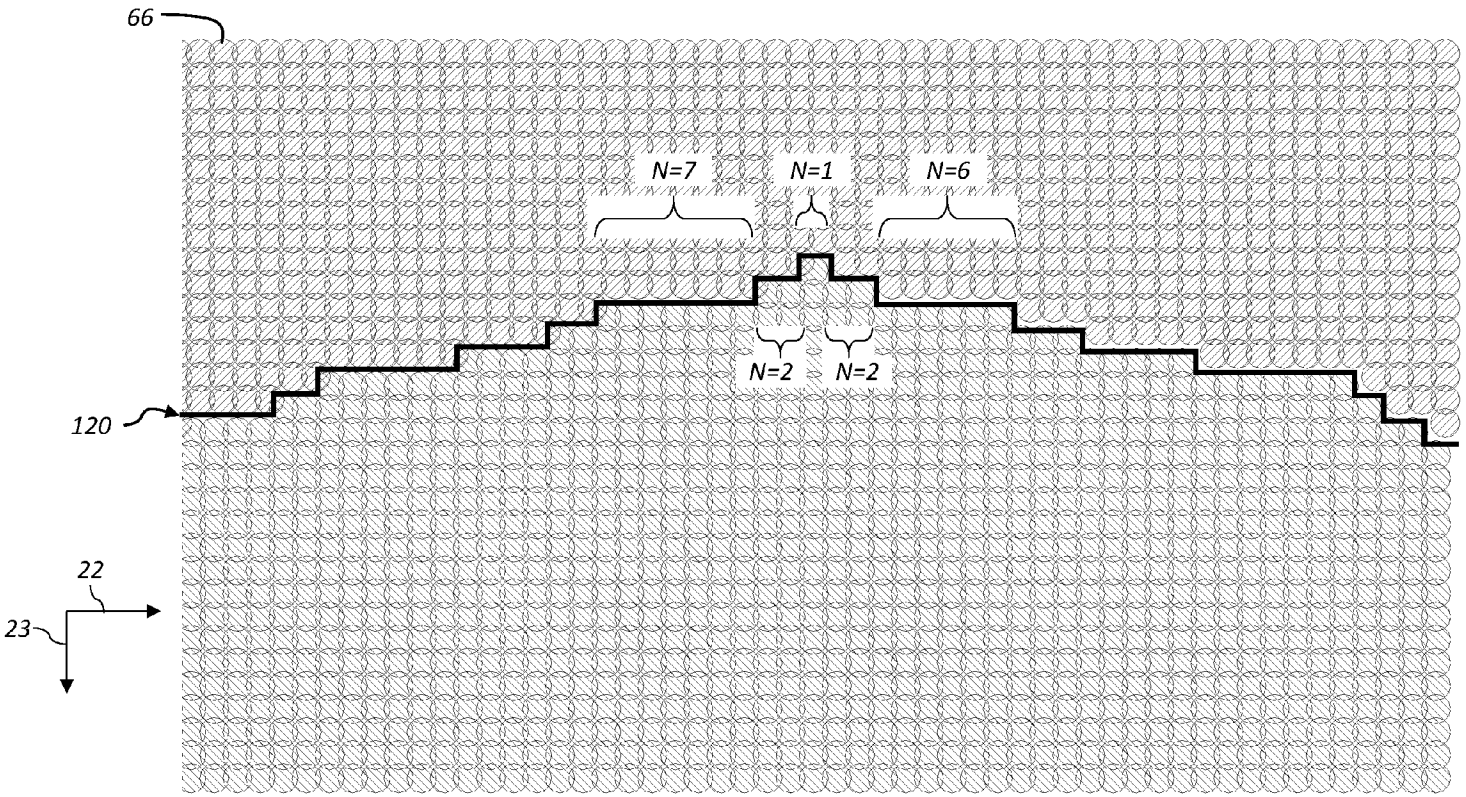
FIG. 8 illustrates a migrating transition boundary in accordance with the present invention.

This process causes the transition boundary to drift back and forth across the defined transition boundary range. This is illustrated in FIG. 8, which shows a portion of the printed media. The in-track direction 22 and cross-track direction 23 are as shown. The printed pixels 66 above the transition boundary 120 in the figure are printed by a first printhead, and the printed pixels 66 below the transition boundary 120 are printed by a second printhead. (The printhead used to print each pixel 66 is indicated by the direction of the hatch pattern.) The pixels printed by the second printheads are intentionally offset in both the in-track direction 22 and the cross-rack direction 23 relative to the pixels printed by the first printhead. The transition boundary 120 is incrementally shifted in the cross-track direction in steps of one pixel, first upward in the figure and then downward. The incremental cross-track shifts of the transition boundary 120 are spaced out in the in-track direction by random numbers of print rows. In this example, the row interval N varies from 1 to 7, with the row interval values N being labeled for 5 segments. By incrementally shifting the transition boundary in the cross-track direction 23 at random or pseudo-random intervals in the in-track direction 22, the visibility of the stitch is reduced when compared to a stitch having a fixed transition boundary.

Figure 9:
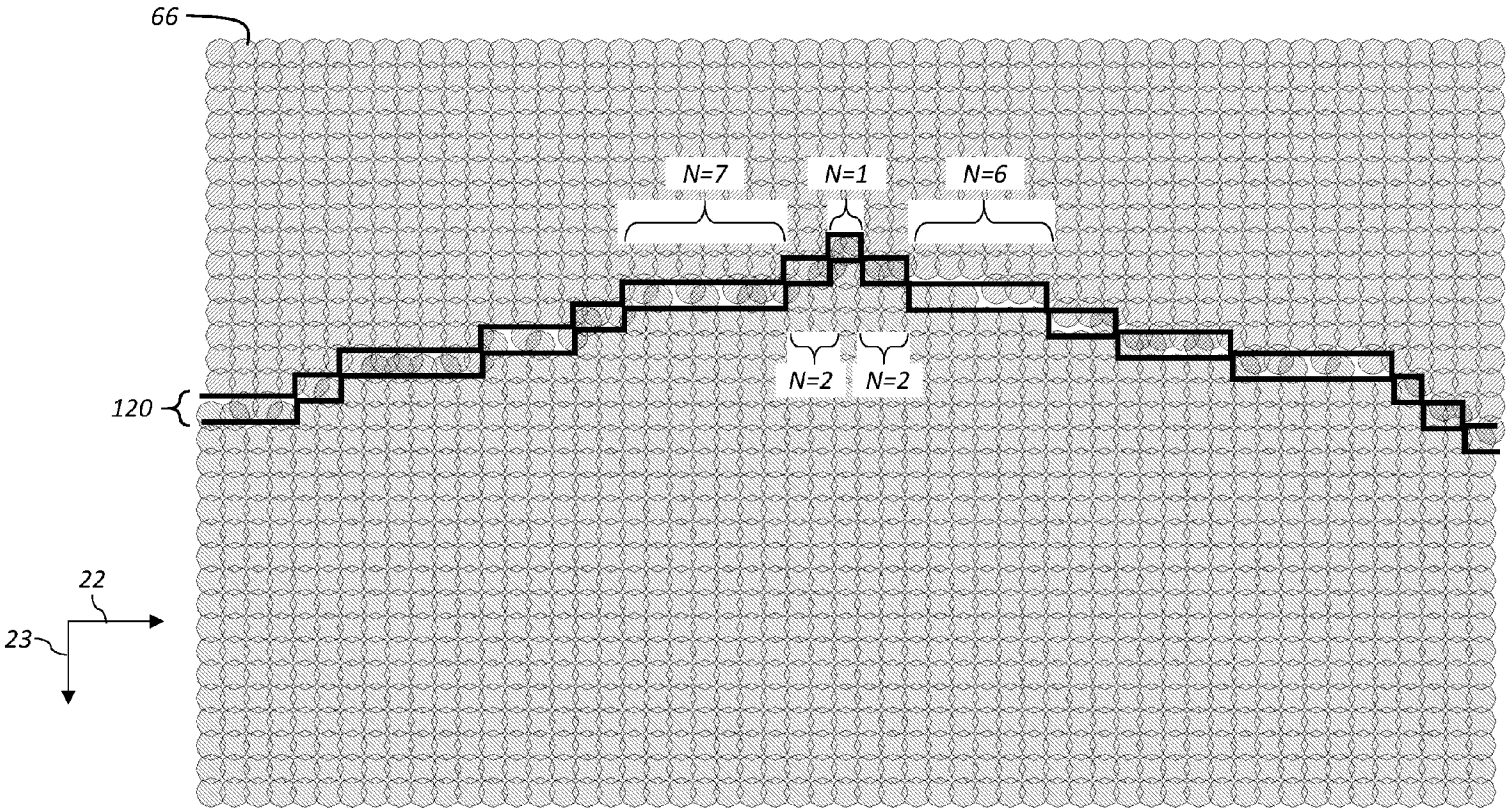
FIG. 9 illustrates a migrating transition boundary having a 1-pixel wide transition zone.
Figure 10:
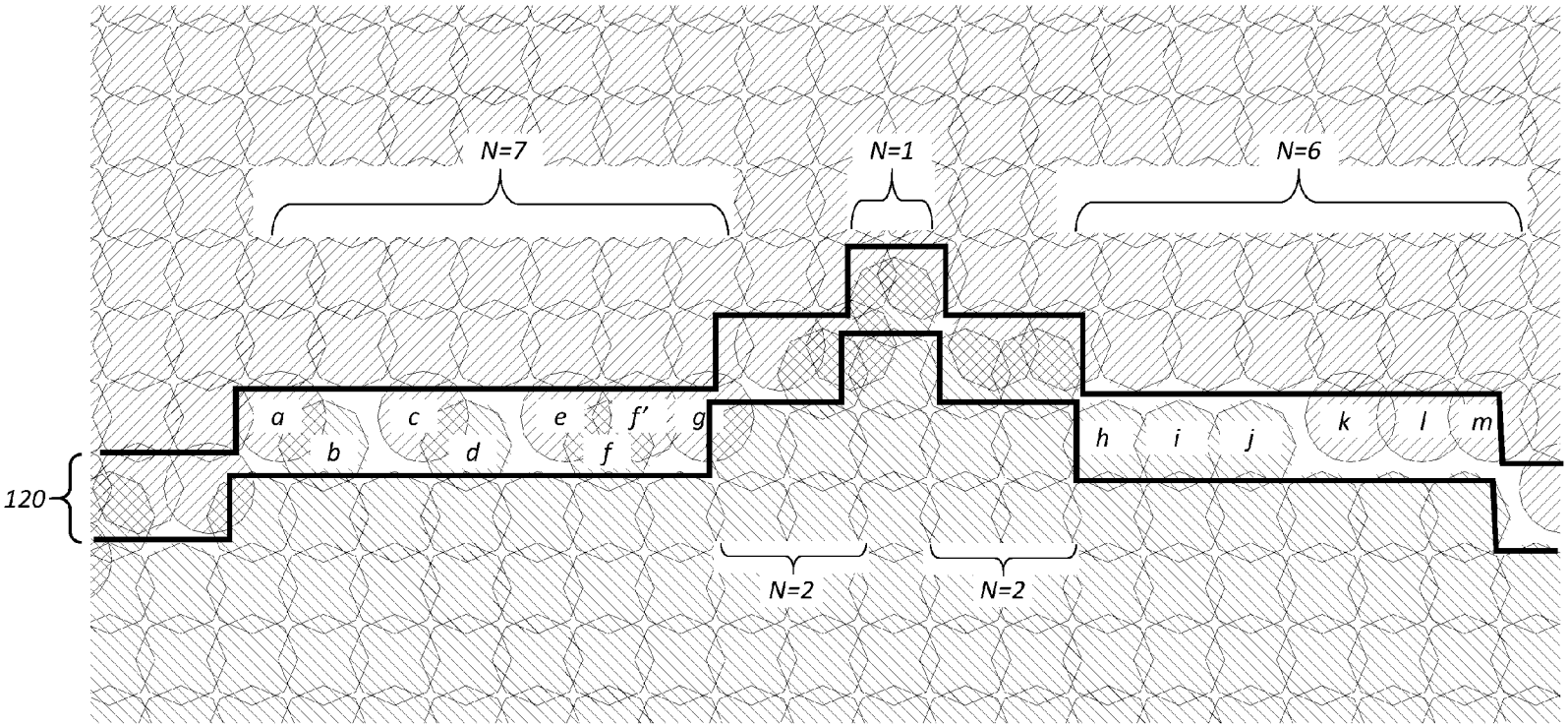
FIG. 10 illustrates a migrating transition boundary having a 1-pixel wide transition zone.

In the example of FIG. 8, the transition boundary 120 is a simple boundary line having a width of zero pixels. In some embodiments, the transition boundary 120 is a transition zone having a zone width as determined in optional define transition zone width step 108 of FIG. 6. The zone width is preferably between one and six pixels wide, and more preferably is one or two pixels wide. In randomize pixel selection in transition zone step 109, the individual pixels within the transition zone are randomly or pseudo-randomly selected to be printed by the first printhead, by the second printhead, or by both the first printhead and the second printhead. This randomized pixel selection process can help to reduce the visibility of the stitching errors at any particular placement of the transition boundary. Such a randomized pixel selection is illustrated in FIGS. 9 and 10. The portion of the printed image in FIG. 9 corresponds to the same portion of the printed image that is shown in FIG. 8. While FIG. 8 has a transition boundary with zero width, FIG. 9 illustrates a transition boundary 120 which is a transition zone having a width of 1 pixel. In the transition zone each pixel is randomly or pseudo-randomly selected to be printed by the first printhead, by the second printhead, or by both the first printhead and the second printhead.

FIG. 10 shows an enlarged view of a central portion FIG. 9. In these figures, the pixels printed by the first printhead are denoted by an upward sloping hatch pattern, and the pixels printed by the second printhead are denoted by a downward sloping hatch pattern. In FIG. 10, the individual pixels in the transition zone of the transition boundary 120 for the segment having a row interval of N=7 have been labeled from a-g, and the pixels in the segment have a row interval of N=6 have been labeled from h-m. The randomized pixel selection process selected pixels a, c, e, g and k-m to be printed by the first printhead, and it selected pixels b, d, and h-j to be printed by the second printhead. The randomized pixel selection process selected pixel f to be printed by both the first printhead and the second printheads with the printhead spots denoted by f' and f respectively.

Figure 11:
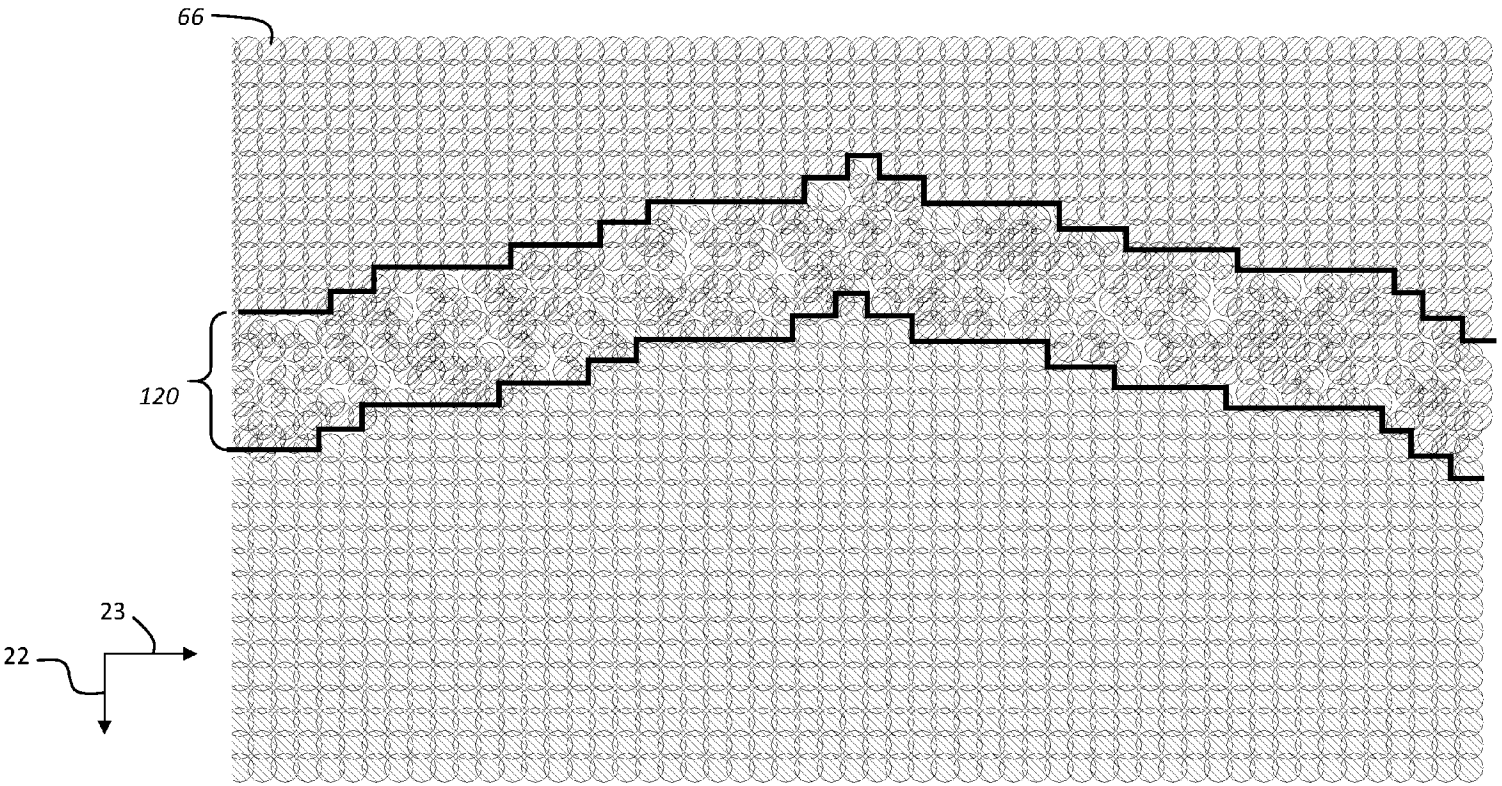
FIG. 11 illustrates a migrating transition boundary having a 6-pixel wide transition zone.

FIG. 11 illustrates an example similar to that shown in FIG. 9 except that that the transition boundary 120 is a 6-pixel wide transition zone. As with the example shown in FIG. 9, the pixels in the transition boundary 120 are randomly or pseudo-randomly selected to be printed by the first printhead, by the second printhead, or by both the first printhead and the second printhead.

In some embodiments, the pixel selection process of randomize pixel selection in transition zone step 109 includes defining a two-dimensional array of dither values which is tiled within the transition zone, wherein a first dimension of the dither array is addressed using a row number and a second dimension is addressed using a cross-track pixel position. In some arrangements, the width of the dither array in the second dimension corresponds to the width of the transition zone and the second dimension is addressed by a cross-track pixel position within the transition zone. In other arrangements, the width of the dither array corresponds to the width of the transition boundary range and the second dimension is addressed by a cross-track pixel position within the transition boundary. The length of the dither array defines a repeat length of the randomization pattern in the in-track direction 22. Preferably the repeat length corresponds to a distance of 256 pixels in the in-track direction 22 to reduce the chance of the repeat pattern being discerned by an observer. The dither values stored at each position within the dither array provide an indication of whether the corresponding pixel is to be printed by the first printhead, by the second printhead, or by both the first printhead and the second printhead. In an exemplary configuration, a dither value of "1" can indicate that the pixel is to be printed by the first printhead, a dither value of "2" can indicate that the pixel is to be printed by the second printhead, and a dither value of "3" can indicate that the pixel is to be printed by both the first printhead and the second printhead. In another exemplary configuration, the dither values can span a specified range (e.g., 0-255), and threshold values can be used to determine how a pixel should be printed. For example, dither values below a first threshold value can indicate that the pixel is to be printed by the first printhead, dither values above a second threshold can indicate that the pixel is to be printed by the second printhead, and dither values between the first and second threshold can indicate that the pixel is to be printed by both the first printhead and the second printhead. This arrangement is convenient to use for embodiments in which it is desired to adjust the fraction of the pixels to be printed with both the first and second printheads as a function of various system parameters.

The array of dither values is preferably determined using a stochastic process. In some embodiments, the stochastic process has blue-noise characteristics. As is well known in the art, having blue-noise characteristics implies that a Fourier transform of the dither array does not have a uniform spread of spatial frequency content, but rather has comparatively less low spatial frequency content and comparatively more high frequency content. Dither arrays with such blue noise characteristics reduces the chance that several consecutive pixels will be selected to be printed by the same printhead as was seen to occur with pixels h-j and then again with pixels k-m. By reducing the chance of several pixels in a row being printed with the same printhead, such blue noise dither arrays tend to reduce the visibility of the transition boundary.

As the detectability of artifacts at the transition boundary depends in part on the in-track length between lateral shifts of the transition boundary, some embodiments vary the width of the transition zone depending on the row interval value N. For example, the zone width might be set to zero for vary small values of N, and zone widths of up to six might be selected when the row interval values are quite large.

In the transition zone, a subset of the pixels is randomly or pseudo-randomly selected to be printed using both the first and the second printheads. The random pixel selection process can include a weighting parameter that alter the fraction of pixels selected to be printed using both the first and the second printheads. In embodiments in which the pixel selection process includes a dither array, a plurality of dither arrays can be generated in which the different dither arrays provide different fractions of pixels being printed by both the first and the second printheads. In general, the fraction of pixels that are printed by both the first and the second printheads can assume any value between 0% and 100%, but preferably is between 10% and 70% of the pixels in the transition zone are printed with both the first printhead and the second printhead. In a preferred embodiment, 40% of the pixels in the transition zone are printed with both the first printhead and the second printhead.

It has been found that the optimum fraction of the pixels to be printed by both the first and the second printheads depends on the image data ink coverage levels, the relative alignment of the first and the second printheads, and the printed dot size (which depends on the type of paper used), the print speed (i.e., the relative speed of the print medium past the printheads), the acceleration rate of the print medium, and the nozzle size. In light of this, some embodiments vary the fraction of the pixels in the transition zone that are printed with both the first printhead and the second printhead in responsive to one or more of print speed, print coverage, type of print medium, nozzle size, print medium acceleration rate, and the relative alignment of the first and second printheads. In these embodiments, the varying fraction of the pixels in the transition zone that are printed with both the first printhead and the second printhead preferably remains in the range of 10% to 70% of the transition zone pixels.

Some embodiments of the invention include one or more image sensors, such as the stitching cameras 52 in FIG. 5, to acquire images of the printed image in the one or more overlap regions 24 across the width of the print medium 16. An image analysis system, such as the stitching camera processing system 56 analyzes the acquired images. The analysis can include, but is not limited to, determining the relative alignment of the print of the first and the second printhead at an overlap region, the printed dot size, and variations in average print density across a region that includes an overlap region and portions of the first and the second swaths adjacent to the overlap region. In response to the output of such image analyses, the processor can alter the fraction of the pixels in the transition zone that are printed with both the first and the second printhead.

When printing color images, made up of a plurality of color planes, the risk that artifacts at the transition boundaries of the different color planes might be detected by an observer increases when the transition boundaries of multiple color planes are aligned with each other for an extended distance in the in-track direction. In recognition of this, in some embodiments different initial positions of the transition boundary are selected for each of the color planes. In some embodiments the row interval values can be independently determined for each color plane. For example, in embodiments in which the row interval values, N, are retrieved from a pre-defined random sequence of row interval values, the row interval values for different color planes can be retrieved from a single pre-defined random sequence of values, but starting at different points in the sequence of values. In some embodiments, in which the row interval values correspond to a random integer within some range multiplied by a step size parameter, the row interval values for the different color planes can be derived using different step size parameters to alter the transition boundary migration rate for the different color planes. In one exemplary configuration, the row interval values for a cyan color plane range from 8 to 200 in steps of 8, the row interval values for a magenta color plane range from 24 to 600 in steps of 24, the row interval values for a yellow color plane range from 2 to 50 in steps of 2, and the row interval values for a black color plane range from 168 to 400 in steps of 16. In some embodiments, the transition boundary range through which the transition boundary can migrate is defined to be different for the different color planes. It must be recognized that since the different transition boundaries are required to migrate back and forth across defined cross-track ranges there will be times when the transition boundaries of the different image planes will cross each other. While different transition boundaries will be aligned as they cross paths with each other, they will be aligned with each other for only a short distance in the in-track direction.

When printing images having multiple overlap regions across the width of the print medium, it is desirable to avoid moving the multiple transition boundaries across the width of the print medium 16 in synchronization with each other. In some embodiments, the row interval values are independently determined for each overlap region across the width of the print medium 16. In some embodiments in which the row interval values, N, are retrieved from pre-defined random sequence of values, the row interval values for the different overlap regions across the print medium are retrieved from a single pre-defined random sequence of values, but starting at different points in the sequence of values. In some embodiments, in which the row interval values correspond to a random integer within some range multiplied by a step size parameter, the row interval values for the different overlap regions across the print medium can be derived using different step size parameters to alter the transition boundary migration rate for the different overlap regions.

Some embodiments of the invention include a step of analyzing the image data to identify the location of non-printing regions within the overlap region for at least one color plane. For example, a non-printing region could correspond to while areas between text characters. In such non-printing regions, the transition boundary can be moved one or more pixels laterally without creating any stitching artifacts. The method therefore can adjust the updated row interval so that a shift of the position of the transition boundary occurs within an identified non-printing region. The method can further allow the transition boundary shifts within an identified non-printing region to be larger than the normal increment value.

The invention has been described in detail with particular reference to certain preferred embodiments thereof, but it will be understood that variations and modifications can be effected within the spirit and scope of the invention.

PARTS LIST

2 jetting module
3 print boundary
4 linehead
6 nozzles
7*a* first row
7*b* second row
8*a* "white-line" artifact
8*b* "dark-line" artifact
10 printer
12 housing
14 linehead
16 print medium
18 jetting modules
20 nozzles
22 in-track direction
23 cross-track direction
24 overlap region
30 media transport system
32 motor
34 pinch rollers
36 processor
38 user input system
40 sensors
42 memory
44 display
50 remote computer system
52 stitching camera
53*a* patch
53*b* patch
54 stitching calibration target
54*a* gap
55 stitch joint
56 stitching camera processing system
58 stitching algorithm
60 print band
62 swath
62*a* swath
62*b* swath
64 seam
64*a* seam
64*b* seam
66 pixel
68 stitch boundary
70 gap
72 excessive coverage region
74 interdigitated fingers
80 provide overlapping printheads step
82 define initial position of transition boundary step
83 define allowed values of row interval step
84 select initial row interval step
86 receive image data step
88 print rows of image data step
90 end of print data test
92 end of range test
96 define transition boundary range step
98 define initial increment direction step
99 define increment amount step
100 done step
102 reverse increment direction step
104 shift transition boundary step
106 change row interval step
108 define transition zone width step
109 randomize pixel selection in transition zone step
120 transition boundary
130 nozzle positions
135 printed dot positions
140 drop trajectories

The invention claimed is:

1. A method for printing image data including rows of image pixels with a printing system having a plurality of printheads for printing a particular image plane in a single pass, the printheads being oriented in a cross-track direction onto a print medium moving past the printheads in an in-track direction, wherein first and second printheads overlap in the cross-track direction defining an overlap region such that image pixels corresponding to the overlap region can be printed with either the first printhead or the second printhead, comprising:

a) defining an initial position of a transition boundary within the overlap region;

b) defining an initial row interval N, where N>1;

c) printing N rows of image pixels wherein image pixels on a first side of the transition boundary are printed using the first printhead and image pixels on a second side of the transition boundary are printed using the second printhead;

d) using a random or pseudo random process to determine an updated row interval N;

e) shifting the position of the transition boundary by an increment amount of between one pixel and three pixels in the cross-track direction; and f) repeating steps c)-e) a plurality of times.

2. The method of claim 1, wherein the position of the transition boundary is shifted by an increment amount of one pixel.

3. The method of claim 1, wherein the transition boundary is a transition zone having a zone width, and wherein a random or pseudo random pixel selection process is used to determine whether each pixel within the transition zone is printed with the first printhead, with the second printhead, or with both the first printhead and the second printhead.

4. The method of claim 3, wherein the zone width is between one pixel and six pixels.

5. The method of claim 3, wherein the pixel selection process includes defining a two-dimensional dither array of dither values which is tiled within the overlap region, wherein a first dimension of the dither array is addressed using a row number and a second dimension of the dither array is addressed using a cross-track pixel position, and wherein the dither values stored at each position within the array provide an indication of whether the corresponding pixel is to be printed with the first printhead, with the second printhead, or with both the first printhead and the second printhead.

6. The method of claim 5, wherein the array of dither values is determined using a stochastic process.

7. The method of claim 6, wherein the stochastic process provides an array of dither values having blue-noise characteristics.

8. The method of claim 3, wherein a fraction of the pixels in the transition zone that are printed with both the first printhead and the second printhead is varied responsive to one or more of print speed, print coverage, type of print medium, nozzle size, print medium acceleration rate, and the relative alignment of the first and second printheads.

9. The method of claim 3, wherein the printing system further includes:

an image sensor for acquiring images of the printed image pixels in the overlap region;

an image analysis system for analyzing the acquired images; and where a fraction of the pixels in the transition zone that are printed with both the first printhead and the second printhead is varied responsive to an output from the image analysis system.

10. The method of claim 3, wherein between 10% and 70% of the pixels in the transition zone are printed with both the first printhead and the second printhead.

11. The method of claim 1, wherein the position of the transition boundary is shifted back and forth within of the overlap region.

12. The method of claim 11, wherein the position of the transition boundary is shifted in a forward cross-track direction until it reaches one edge of the overlap region and then the position of the transition boundary is shifted in a backward cross-track direction until it reaches an opposing second edge of the overlap region.

13. The method of claim 1, wherein the random or pseudo random process determines the updated row interval N by selecting one of a predefined set of row intervals.

14. The method of claim 1, wherein the row intervals in the predefined set of row intervals are between 2 rows and 900 rows.

15. The method of claim 1, wherein the row intervals in the predefined set of row intervals are selected so that the spacing between the rows where the position of the transition boundary is shifted is between 0.001 inches and 0.5 inches.

16. The method of claim 1, wherein the printing systems prints a plurality of image planes, and wherein the row intervals are determined independently for each image plane.

17. The method of claim 1, wherein the overlap region is between 15 and 40 pixels wide.

18. The method of claim 1, further including analyzing the image data to identify a non-printing region in the overlap region and adjusting the updated row interval so that the position of the transition boundary is shifted to be within the non-printing region.

19. The method of claim 1, wherein the printing system is an inkjet printing system and the first and second printheads are inkjet jetting modules.

* * * * *